US005715761A

United States Patent [19]

Frattini

[11] Patent Number: 5,715,761

[45] Date of Patent: Feb. 10, 1998

[54] ARTICLE OF FURNITURE INCLUDING A LEG HAVING WIRE MANAGEMENT CAPABILITIES

[75] Inventor: Emanuela Frattini, New York, N.Y.

[73] Assignee: Knoll, Inc., East Greenville, Pa.

[21] Appl. No.: 465,065

[22] Filed: Aug. 1, 1995

[51] Int. Cl.[6] ..... A47B 83/00

[52] U.S. Cl. ..... 108/50; 312/223.6; 248/49

[58] Field of Search ..... 108/50, 190; 52/220.7; 403/10; 312/223.6, 223.3; 248/49

[56] References Cited

U.S. PATENT DOCUMENTS

| | | | |
|---|---|---|---|
| D. 342,403 | 12/1993 | Magnusson . | |
| 2,842,412 | 7/1958 | Mackintosh . | |
| 4,094,561 | 6/1978 | Wolff et al. . | |
| 4,463,057 | 7/1984 | Knurr . | |
| 4,535,703 | 8/1985 | Henriott et al. | 108/50 |
| 4,748,913 | 6/1988 | Favaretto et al. | 108/50 |
| 4,807,838 | 2/1989 | Anderson . | |
| 5,144,896 | 9/1992 | Fortsch . | |
| 5,154,126 | 10/1992 | Newhouse et al. . | |
| 5,357,874 | 10/1994 | Palmer | 312/223.6 X |
| 5,370,223 | 12/1994 | Leicht, Jr. . | |
| 5,435,254 | 7/1995 | Amey et al. | 108/50 X |

FOREIGN PATENT DOCUMENTS

| | | | |
|---|---|---|---|
| 544027 | 6/1993 | European Pat. Off. | 248/49 |
| 3924690 | 4/1990 | Germany | 248/49 |
| 22494 | 10/1909 | United Kingdom | 292/175 |

OTHER PUBLICATIONS

*Contract Design*—pp. 13 & 14, Issue 5, vol. 36, published by Miller Freeman, Inc., May 1994.

*Contract Design*—p. 24, Issue 2, vol. 37, published by Miller Freeman, Inc., Feb. 1995.

*Contract Design*—p. 26, Issue 4, vol. 37, published by Miller Freeman, Inc., Apr. 1995.

*Primary Examiner*—Peter M. Cuomo

*Assistant Examiner*—Hanh V. Tran

*Attorney, Agent, or Firm*—Buchanan Ingersoll, P.C.

[57] ABSTRACT

An article of furniture including a leg or legs having wire management capabilities whereby the leg includes channels open along their length and slots at one end of each channel. Each slot extends for the length of each channel so that wires may be disposed in each channel through the slot. The leg further includes flexible members, each flexible member having a rigid, first side fixedly attached to one end of each slot and a flexible second side extending to cover each slot. The second side of the flexible member may be pushed inwardly into either channel opening so that the wires may be laid into the channel through the slot.

25 Claims, 7 Drawing Sheets

ARTICLE OF FURNITURE INCLUDING A LEG HAVING WIRE MANAGEMENT CAPABILITIES

BACKGROUND OF THE INVENTION

1. Field of the Invention

This invention relates to an article of furniture including a leg or legs having wire management capabilities, and more particularly to a table having four legs having open wire channels covered by transparent flexible members whereby electrical and/or data and communication wiring may be laid in easily and effortlessly.

2. Description of the Related Art

As the modern work environment continues to evolve, there exists more need to be able to work in spaces not typically defined by a closed office having four walls and a door. Also, the increase in all types of electrical and communication and data equipment requires an article of furniture to be located near electrical and communication outlets. Therefore, office furniture requires more flexibility and portability.

Articles of furniture including legs having wire management capabilities are well known in the art. The articles range from tables to desks to other types of furniture. Most of these table and desk legs have open channels through which to run electrical or communication wires so that the wires do not take up much needed work space on the top of the table or desk. The electrical and communication wires are connected to various types of office equipment including telephones, computers and fax machines. However, the wires must be "fished" or threaded through an opening on the desk or table top and through the leg in order to reach the floor. This procedure can become complicated and cumbersome as equipment is continually updated or removed from the furniture top. Also, industry standards require that electrical and power wires be separated from communication wires. Thus, the existing articles of furniture may only accommodate certain types of equipment at one time.

Consequently, there exists a need for an article of furniture including a leg having wire management capabilities where electrical and communication wiring can be housed in the same leg and where the wires can be easily laid in or removed as equipment is added, updated or removed.

SUMMARY OF THE INVENTION

In accordance with the present invention, the foregoing deficiencies of the prior art are obviated by providing an article of furniture including a leg having wire management capabilities whereby the leg includes channels open along their length and slots at one end of each channel. Each slot also extends for the length of each channel so that wires may be disposed in each channel through the slot. A flexible member is fixedly attached to one end of each slot and extends to cover the slot so that the wires housed in the channel are kept in place. The wires may be laid in either channel by pushing the flexible member inwardly toward the channel opening.

BRIEF DESCRIPTION OF THE DRAWINGS

While the specification concludes with the claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention herein described provides an article of furniture having a leg or legs having several open channels extending the length of the leg to accommodate electrical and/or data and communication wires which are connected to various types of office equipment which may be stored or used on the article of furniture. The channels include slots covered by a flexible member enabling a user to push the flexible member inwardly toward the channel opening so as to place or "lay in" the wires into the channels of the leg in order to prevent wires from dangling from the top of the article of furniture, thus creating an unsightly appearance.

Figure 1:
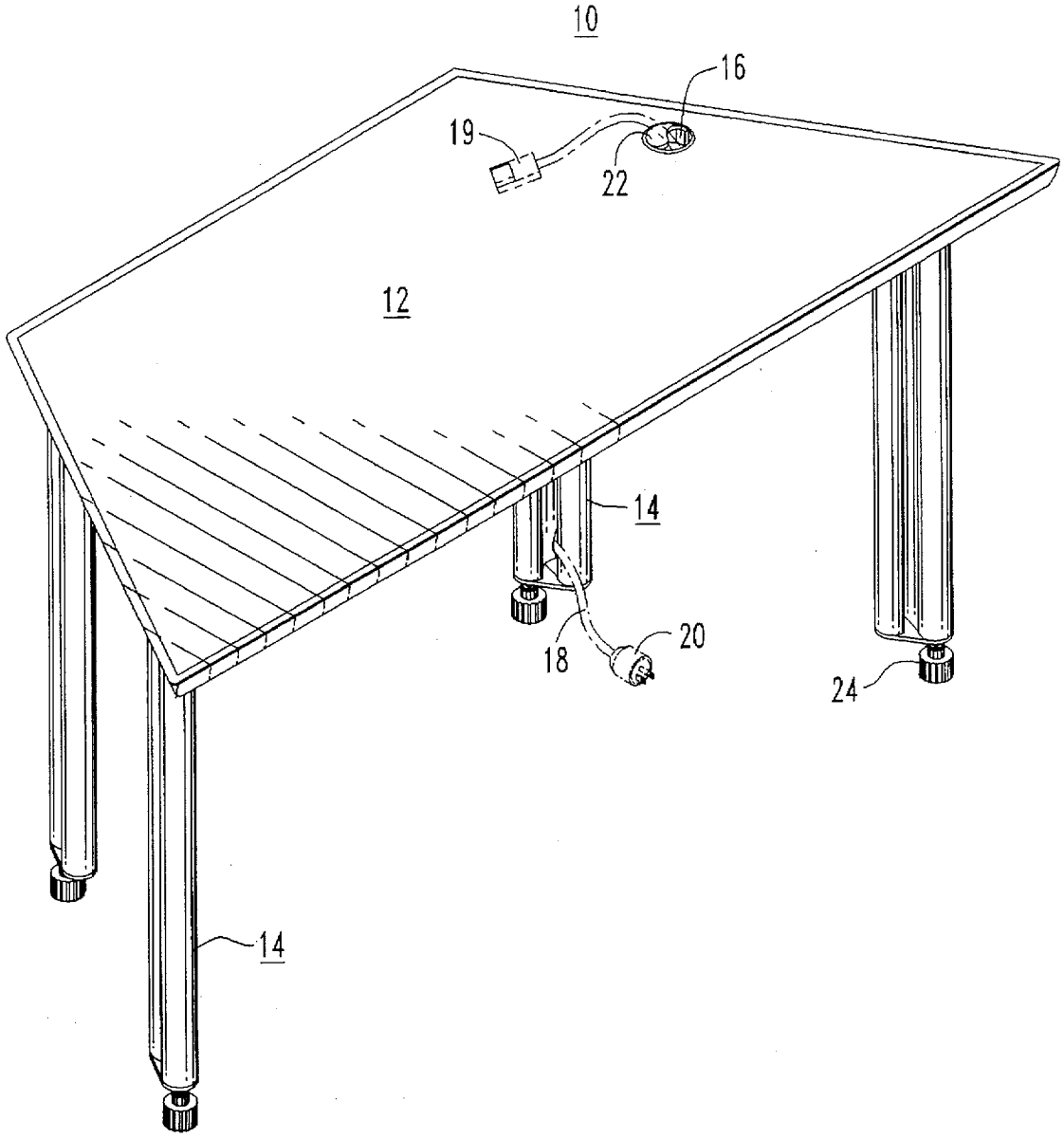
FIG. 1 is a perspective view of an article of furniture having legs with wire management capabilities.

Referring now in detail to the drawings wherein like reference characters represent like parts throughout the several views, there is illustrated in FIG. 1 an article of furniture, in this case a table 10 which may be used in an office, conference room or other type of a work environment. Table 10 may accommodate various types of office equipment (not shown) such as computers, telephones and fax machines. Table 10 has a top 12 which may be trapezoidal in shape, four legs 14 and one or more circular grommets 16 in top 12 of table 10 through which wires 18 (shown in phantom) may be passed. The wires 18 may be any sort of wires including electrical wiring **18*a* for powering a personal or laptop computer, a calculator or other office equipment or communication and data wires 18*b* for computers, telephones and fax machines. The wires are connected to the various types of office equipment previously mentioned by a connector 19, for example. Wire 18 terminates in a plug 20 which may be plugged into any type of electrical receptacle found in the walls or floor of an office. A grommet cap 22 is used to cover grommet 16 in table top 12 in order to partially conceal any wiring 18 that is placed through grommet 16. Grommet cap 22 is removable so that wires 18 may be placed through the grommet 16 or removed if the equipment (not shown) on top 12 of table 10 is removed. If no equipment is stored on the top of table 10, grommet cap 22 is used to cover grommet 16 in order to create a more pleasing appearance to top 12 of table 10 rather than an unsightly opening in the table top 12**.

Leg 14 terminates in a foot or leveler 24 for stabilizing the table. Casters (not shown) may also be used in place of the foot or leveler 24 to enable the table to be portable.

Figure 2:
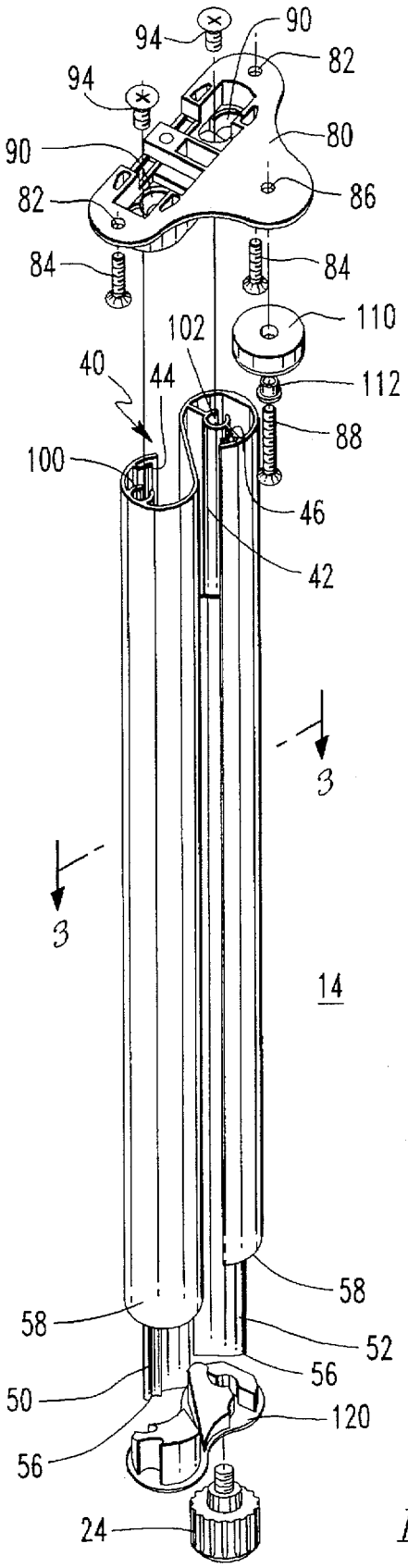
FIG. 2 is an exploded perspective view of one of the legs.
Figure 3:
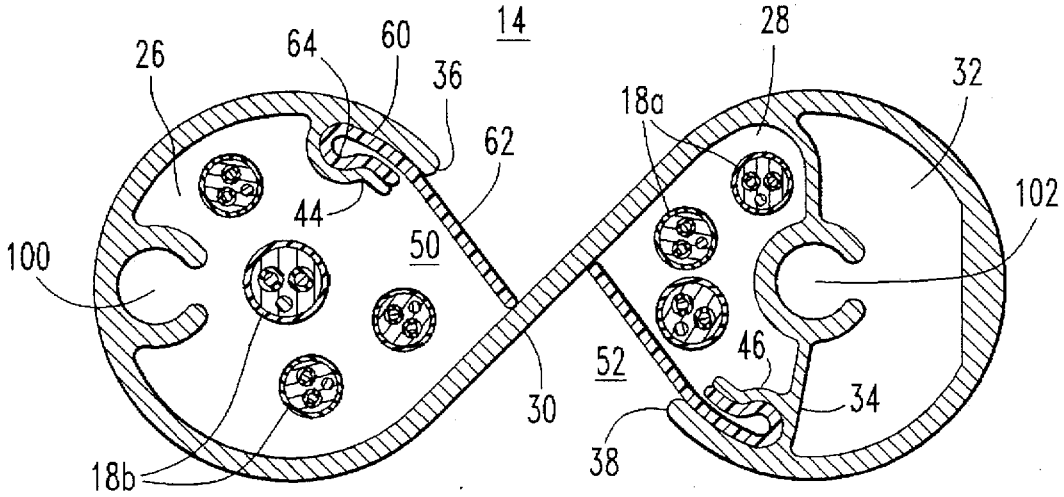
FIG. 3 is a sectional view of the leg taken along line 3—3 of FIG. 2.
Figure 4:
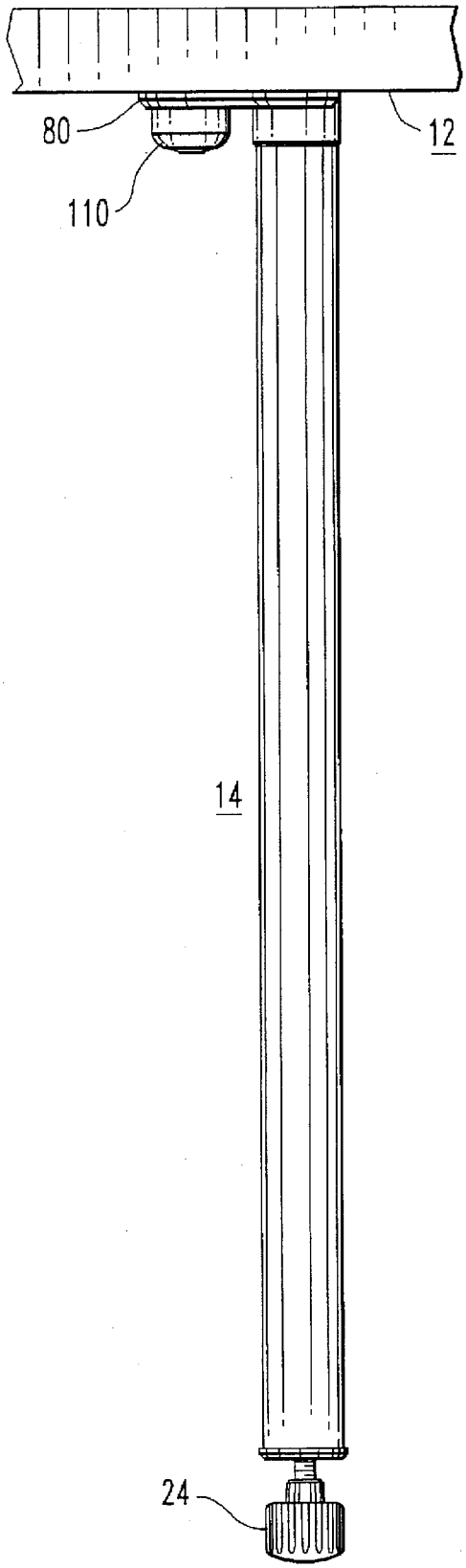
FIG. 4 is a right side elevational view of one of the legs.

Leg 14 will now be described in greater detail. Referring to FIGS. 2 and 3, leg 14, formed of a single piece of extruded aluminum, is curved to resemble the letter "S", or the number "8" without one of its sides, in horizontal cross section. Leg 14 is basically hollow and includes three open, substantially circular, channels which extend the entire length of leg 14. Two of the channels are used as wire passageways to accommodate wires 18 which are connected to the equipment being used on table 10. First channel 26 houses communication and/or data wires 18*b*and a second channel 28 houses what is termed in the industry "dirty" wires, electrical or power cables and wires 18*a*. Industry standards require that electrical or power cables may not be placed or housed next to data/communication cables. Thus, channels 26 and 28 are adjacent to each other and are separated by a wall member 30. A third channel 32 is adjacent to second channel 28, both second and third channels 28 and 32 being separated by a divider 34. Third channel 32 is also an open channel but functions primarily to provide strength to leg 14 and support to table 10. If referring to leg 14 as the letter "S" or the number "8", first channel 26 would comprise the bottom half of the letter "S" or the number "8", while second and third channels 28 and 32 would comprise the upper half of the letter "S" or the number "8".

First channel 26 and second channel 28 have opposing ends 36 and 38 located on either side of wall member 30. End 36 is located approximately one inch to the left of wall member 30 while end 38 is located approximately one inch to the right of wall member 30. If an imaginary line were drawn to connect end 36 and end 38 the imaginary line would comprise the missing side of the number "8" shape mentioned previously. The one inch distance between end 36 and wall member 30 creates a first slot 40, whereas the one inch distance between end 38 and wall member 30 creates a second slot 42. Slots 40 and 42 are best illustrated in FIG. 2. Slots 40 and 42, like channels 26, 28 and 32, are open and extend the entire length of leg 14.

Slots 40 and 42 include curved lip portions 44 and 46 formed near ends 36 and 38 respectively. Lip portions 44 and 46 protrude into channels 26 and 28 respectively as can be seen in FIGS. 2 and 3.

Figure 5:
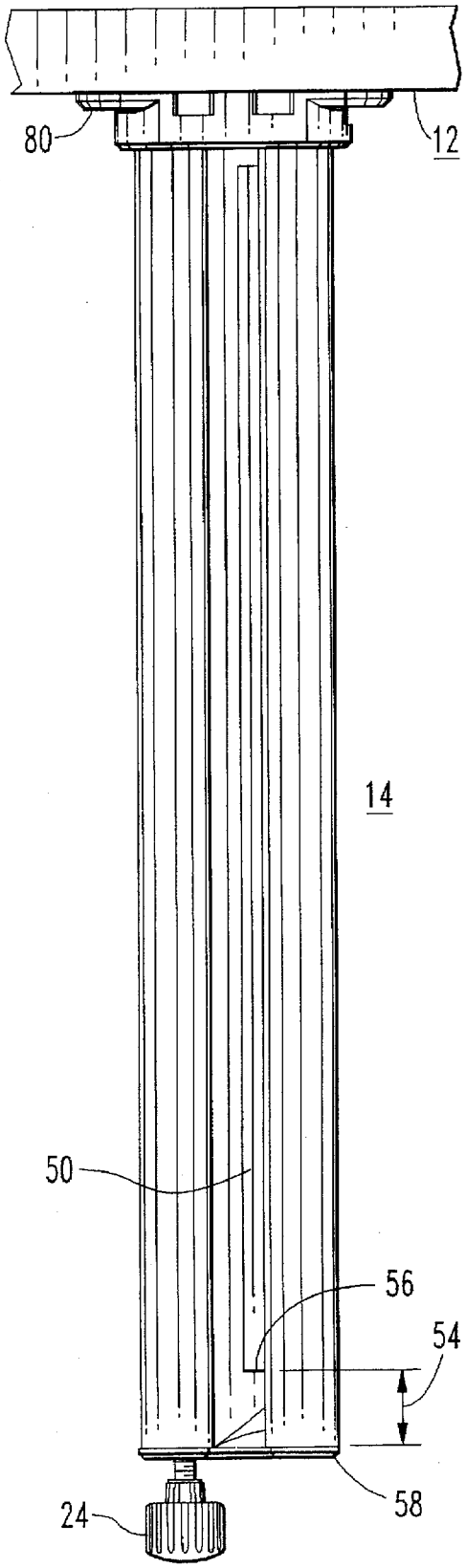
FIG. 5 is a front elevational view of one of the legs.
Figure 6:
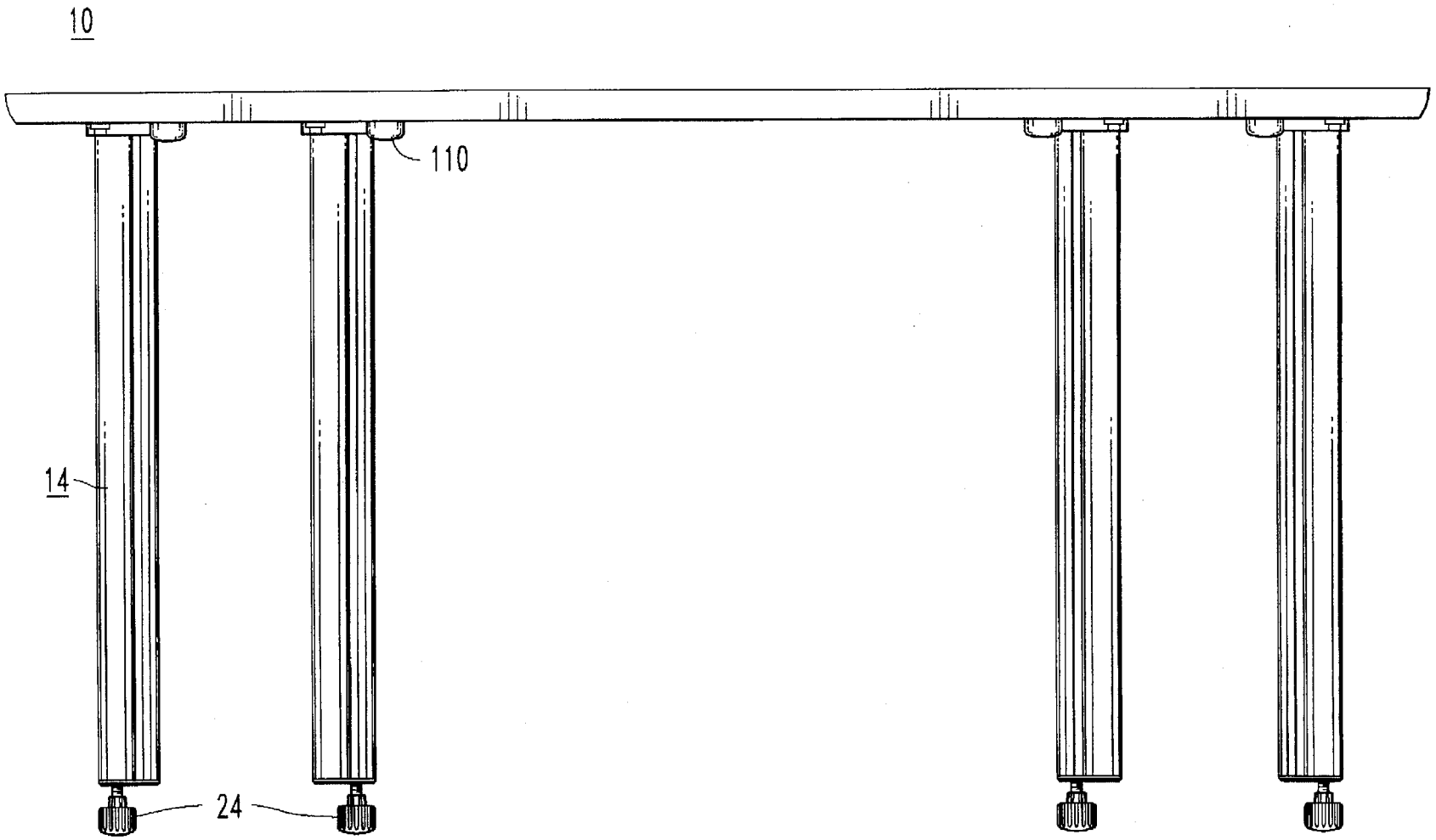
FIG. 6 is a front elevational view of the article of furniture with no wires being illustrated.

Removable flexible members 50, 52 are used to cover slots 40, 42. As flexible members 50, 52 are identical, only flexible member 50 will be discussed in detail for the remainder of the description. Flexible member 50 extends for substantially the entire length of leg 14 so as to substantially cover slot 40. However, flexible member 50 is approximately three inches shorter than the length of leg 14 so that a space 54 is created between the bottom 56 of flexible member 50 and the bottom 58 of leg 14. See FIG. 5. Space 54 accommodates plug 20.

Flexible member 50 is comprised of a transparent, one-piece elastomeric material, preferably polyvinyl-chloride (PVC). Flexible member 50 is transparent so that wires 18 are visible in order to conform to fire safety code regulations. Flexible member 50 is of a dual durometer, in which one side 60 is rigid and a second side 62 is flexible. Side 60 includes a hook portion 64 which is also rigid. In order to cover slot 40, hook portion 64 of flexible member 50 is inserted into lip portion 44 of slot 40 located near end 36 of channel 26. Likewise, hook portion of flexible member 52 is inserted into lip portion 46 of slot 42 located near end 38 of channel 28. Because of the substantially similar curved configuration of both hook portion 64 and lip portions 44, 46, hook portion 64 is thereby held firmly in place by lip portion 44 so that side 60 of flexible member 50 is fixedly attached to one end of slot 40 adjacent end 36 of channel 26. Second side 62 of flexible member extends to abut wall member 30 so as to cover the remainder of slot 40. Because second side 62 is flexible, second side 62 may be pushed inwardly toward the center of channel 26 in order to lay in wires 18*b*. The resilient nature of second side 62 thereby permits second side 62 to "spring" back to cover and retain wires 18*b* now housed in channel 26.

Leg 14 is attached to the under side of table top 12 by a bracket 80. Bracket 80 has three holes, two holes 82 which accept screws 84 and a third hole 86 which accepts a screw 88. Bracket 80 is attached to the under side of table top 12 by screws 84 which are inserted through holes 82 in bracket 80 into holes (not shown) located on the underside of table top 12. Bracket 80 further includes openings 90.

Leg 14 includes grooves 100, 102 which are threaded to accept screws 94. Groove 100 is located in channel 26 while groove 102 is located in divider 34 between channels 28 and 32. Leg 14 is attached to table top 12 by screws 94 inserted through openings 90 in bracket 80 into grooves 100, 102.

Figure 7:
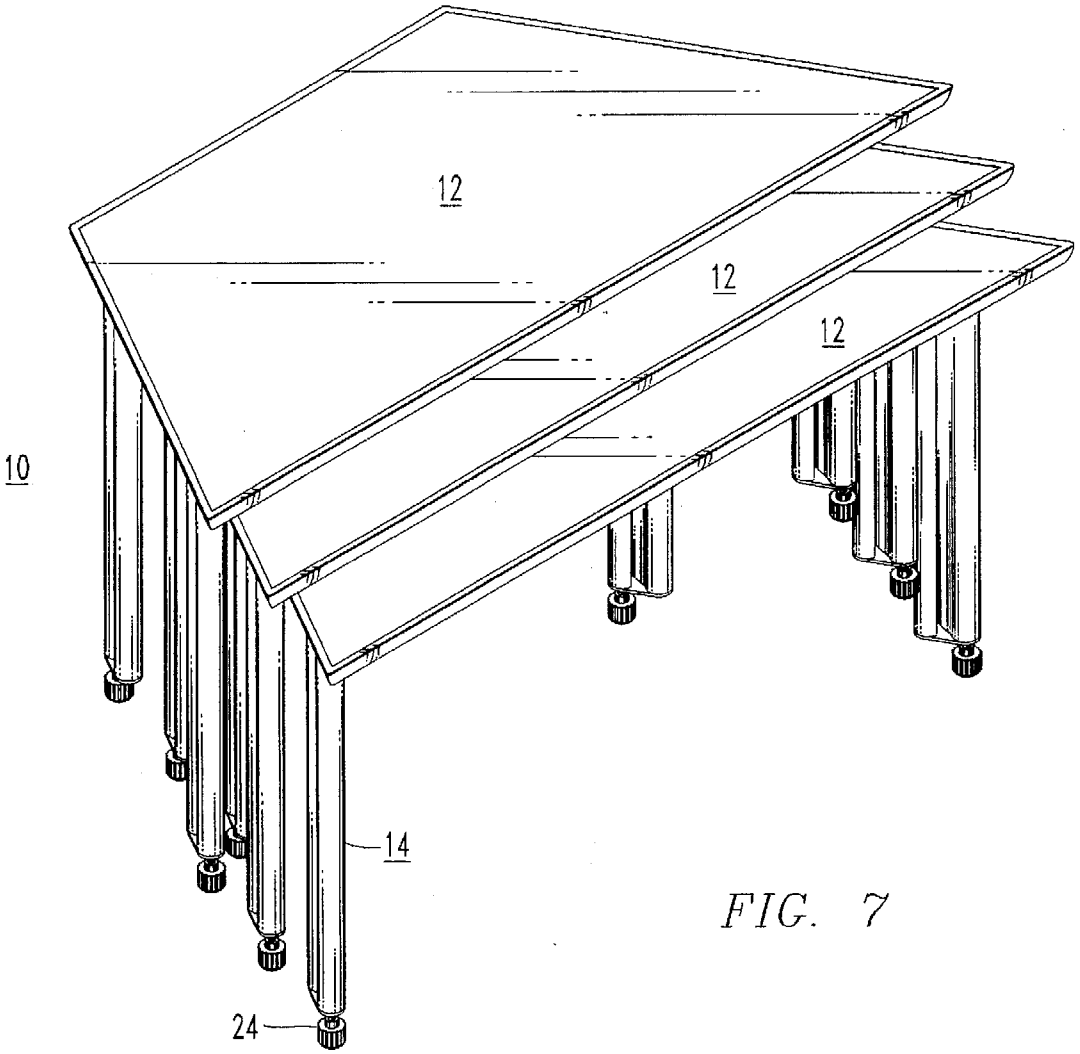
FIG. 7 is perspective view of several articles in a stacked configuration.
Figure 8:
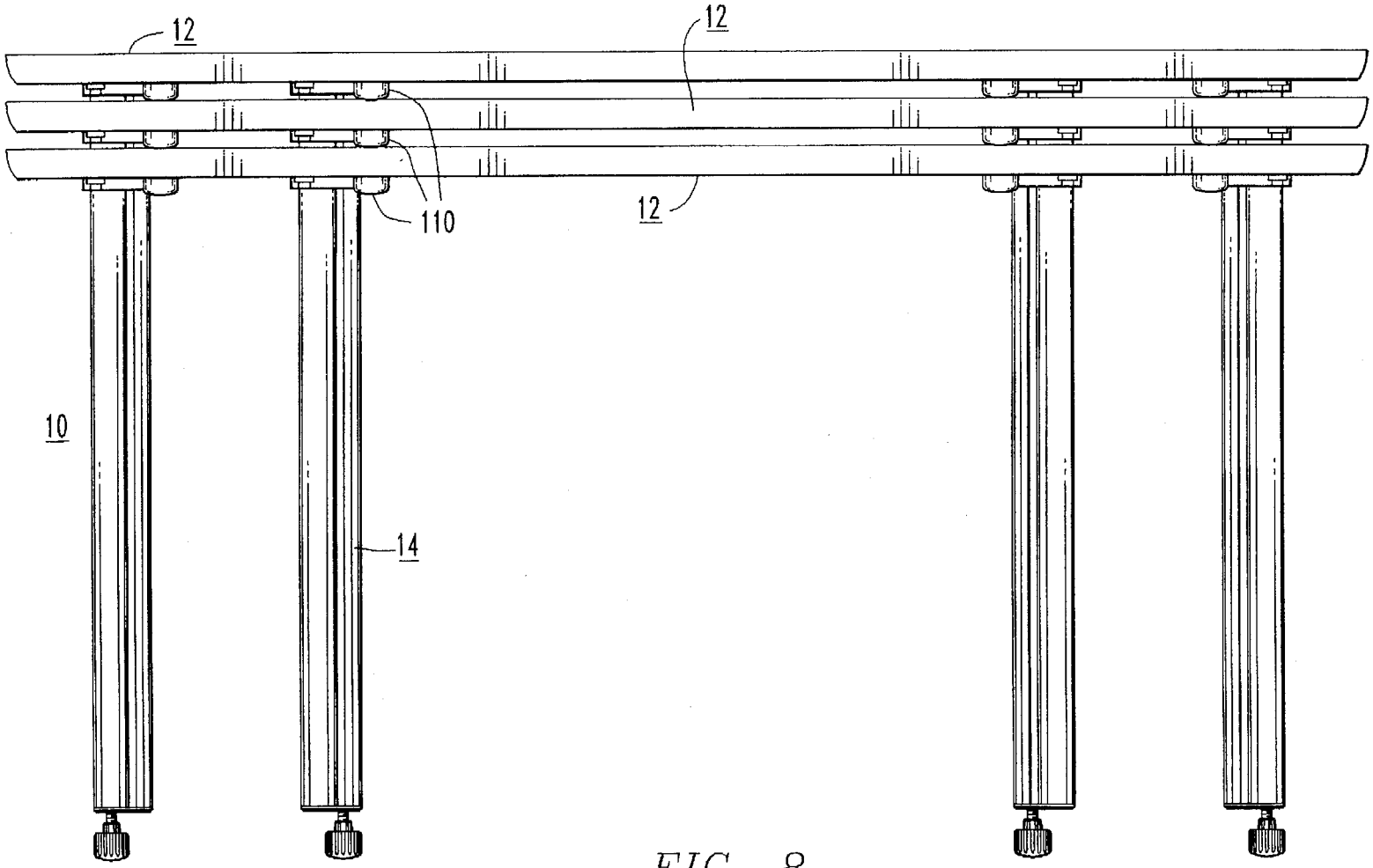
FIG. 8 is a front elevational view of several articles in a stacked configuration.

A rubber bumper 110 is affixed to the underside of bracket 80 by screw 88 and nut 112 through hole 86. Bumper 110 helps to protect table top 12 if more than one table 10 is stacked in a stacked configuration as illustrated in FIGS. 7 and 8.

Finally, leg 14 includes cap 120 snapped into the bottom 58 of leg 14 through which leveler 24 is inserted.

As mentioned previously, the table 10 is very versatile and may accommodate a variety of office equipment such as personal and laptop computers, telephones, fax machines and lamps. Grommets 16 allow any of the wires 18 connected to the equipment to be passed through to the underside of the table 10 so that the wires do not lay on top of the table thereby reducing the area on which one may work. Wires 18 are passed underneath table top 12 and inserted into channel 26 (if the wires are communication and/or data wires 18*b*) or into channel 28 (if the wires 18 are electrical power wires 18*a*) by pushing inwardly on second side 62 of flexible member 50 or 52. The resilient nature of second side 62 of flexible member 50 thereby permits second side 62 to "spring" back to cover and retain wires 18*a* or 18*b*. Plug 20 extends through space 54 so that plug 20 may be plugged into the proper electrical or data receptacle. When the office equipment must be removed in order to make more space available on the table top for example, plug 20 is simply unplugged from the receptacle and wire 18 is easily removed from channel 26 or 28 by pulling toward the user. Second side 62 of flexible member 50 will yield so that the wire may be easily removed. Connector 19 may then be removed from the equipment so that the table is easily cleared without the need for any tools or tugging on the wire through holes and tubes.

I claim:

1. An article of furniture including a leg having wire management capabilities, said leg comprising:

a first channel having an opening along its length;

a slot at one end of said first channel, said slot extending for the length of said channel wherein wires are disposed in said first channel through said slot;

a second channel adjacent to said first channel, said first and second channels separated by a wall member; and a flexible member, said flexible member having a first side fixedly attached to one end of said slot wherein said first side is harder, and a second side abutting said wall member, wherein said second side is more flexible than said first side whereby said second side of said flexible member is pushed inwardly into said opening of said first channel so that said wires are laid in said first channel through said slot.

2. The leg according to claim 1 wherein said flexible member is transparent so that said wires disposed in said first channel through said slot are visible and held in place.

3. The leg according to claim 1 wherein said first channel, said second channel and said wall member comprise an "S" shape in cross section.

4. The leg according to claim 3 wherein said second channel has an opening along its length and includes a slot at one end of said second channel, said slot extending the length of said channel wherein wires are disposed in said second channel through said slot.

5. The leg according to claim 4 further including a second flexible member, said second flexible member having a first side fixedly attached to one end of said slot of said second channel and a second side extending to abut said wall member so as to cover said slot of said second channel.

6. The leg according to claim 5 wherein said first side of said second flexible member is harder and said second side of said second flexible member is more flexible than said first side whereby said second side of said second flexible member is pushed inwardly into said opening of said second channel so that said wires are laid in said second channel through said slot.

7. The leg according to claim 6 wherein said second flexible member is transparent so that said wires disposed in said second channel through said slot of said second channel are visible and are held in place.

8. The leg according to claim 7 wherein said article of furniture is a table.

9. The leg according to claim 8 wherein said table has four legs.

10. The leg according to claim 9 wherein said table includes a trapezoidal shaped top.

11. The leg according to claim 10 wherein said top of said table includes an opening for placing wires.

12. The leg according to claim 11 wherein said wires extend through said opening in said table top and are disposed in said first channel of one of said legs.

13. The leg according to claim 12 wherein said wires extend through said opening in said table top and are disposed in said second channel of one of said legs.

14. The leg according to claim 13 further including a bracket having a top side and a bottom side, said bottom side of said bracket attached to said leg by fastening means.

15. The leg according to claim 14 wherein said fastening means are screws.

16. The leg according to claim 15 wherein said top side of said bracket is attached to the bottom of the table top by fastening means.

17. The leg according to claim 16 wherein said fastening means are screws.

18. The leg according to claim 6 wherein said one end of said slot of said second channel includes a lip portion adapted to receive said first side of said second flexible member so that said first side of said second flexible member is fixedly attached to said one end of said slot of said second channel.

19. The leg according to claim 18 wherein said first side of said second flexible member includes a hook portion adapted to be received by said lip portion of said slot of said second channel.

20. The leg according to claim 1 wherein said one end of said slot includes a lip portion adapted to receive said first side of said flexible member so that said first side of said flexible member is fixedly attached to said one end of said slot.

21. The leg according to claim 20 wherein said first side of said flexible member includes a hook portion adapted to be received by said lip portion of said slot.

22. An article of furniture including a leg having wire management capabilities, said leg comprising:

a first channel having an opening along its length;

a slot at one end of said first channel, said slot extending for the length of said channel wherein wires are disposed in said first channel through said slot;

a second channel adjacent to said first channel, said first and second channels separated by a wall member; and a flexible member, said flexible member having a first side fixedly attached to one end of said slot and a second side abutting said wall member to cover said slot.

23. The leg according to claim 22 wherein said first channel, said second channel and said wall member comprise an "S" shape in cross section.

24. The leg according to claim 23 wherein said second channel has an opening along its length and includes a slot at one end of said second channel, said slot extending the length of said second channel wherein wires are disposed in said second channel through said slot of said second channel.

25. The leg according to claim 24 further including a second flexible member, said second flexible member having a first side fixedly attached to one end of said slot of said second channel and a second side abutting said wall member so as to cover said slot of said second channel.

* * * * *